US006619583B2

(12) United States Patent
Henry et al.

(10) Patent No.: US 6,619,583 B2
(45) Date of Patent: Sep. 16, 2003

(54) DEVICE FOR CONTACT-FREE GUIDANCE OF A WEB MATERIAL OVER A SURFACE

(75) Inventors: Herve Henry, Angiuillers (FR); Thierry Thevenin, Margny les Compiegne (FR)

(73) Assignee: Heidelberger Druckmaschinen AG, Heidelberger (DE)

( * ) Notice: Subject to any disclaimer, the term of this patent is extended or adjusted under 35 U.S.C. 154(b) by 0 days.

(21) Appl. No.: 09/897,282

(22) Filed: Jul. 2, 2001

(65) Prior Publication Data

US 2002/0017589 A1 Feb. 14, 2002

(30) Foreign Application Priority Data

Jun. 30, 2000 (DE) ..... 100 31 814

(51) Int. Cl.[7] ..... B65H 23/32; B41F 13/58

(52) U.S. Cl. ..... 242/615.12; 226/97.3; 242/615.21; 270/5.01

(58) Field of Search ..... 242/615.12, 615.21; 226/97.3; 270/5.01

(56) References Cited

U.S. PATENT DOCUMENTS

| | | | | |
|---|---|---|---|---|
| 3,111,310 A | * | 11/1963 | Dutro et al. | 493/439 |
| 3,191,926 A | * | 6/1965 | Ramaika | 242/615.12 X |
| 3,697,061 A | * | 10/1972 | Levine et al. | 270/5.01 |
| 4,141,544 A | * | 2/1979 | Birkenmayer | 493/355 |
| 4,187,968 A | * | 2/1980 | Winterholler et al. | 242/615.21 X |
| 5,779,616 A | | 7/1998 | Hintermeier et al. | |
| 5,947,026 A | | 9/1999 | Murray et al. | |
| 5,947,411 A | | 9/1999 | Burke et al. | |

FOREIGN PATENT DOCUMENTS

| | | |
|---|---|---|
| DE | 1 142 878 | 1/1963 |
| DE | 2 240 397 | 2/1974 |
| DE | 44 35 528 C2 | 9/1997 |
| DE | 199 05 387 A1 | 9/1999 |
| DE | 199 15 386 A1 | 11/1999 |
| EP | 0 945 385 A2 | 9/1999 |
| JP | 07 047 415 A | 2/1995 |

* cited by examiner

*Primary Examiner*—Michael R. Mansen
(74) *Attorney, Agent, or Firm*—Laurence A. Greenberg; Werner H. Stemer; Gregory L. Mayback

(57) ABSTRACT

A device for contact-free guidance of a web material over a surface element whereon a first longitudinal fold is formed in the web material, the surface element decreasing in width continuously from a top crossmember to a bottom crossmember, and being defined by boundary elements, the surface element and the boundary elements having gaseous medium provided therein, includes an adjustable closure element for varying, in accordance with a respective format of the web material guided over the surface, a flow of a volume of the gaseous medium from an air cushion formed beneath the web material; a device for forming the first longitudinal fold; and an angle-bar superstructure and a web-processing rotary printing machine, respectively, including the fold-forming device.

17 Claims, 4 Drawing Sheets

DEVICE FOR CONTACT-FREE GUIDANCE OF A WEB MATERIAL OVER A SURFACE

BACKGROUND OF THE INVENTION

Field of the Invention

The invention relates to a device for contact-free guidance of a web-like material over a surface, such as a folder former plate, for example, the web-like material being foldable with a first longitudinal fold which is formed therein as it passes the folder former plate.

The published German Patent Document DE 199 15 386 A1 is concerned with a device for avoiding smearing during the transportation of a printed material web, which may be printed on one or both sides thereof. This publication describes a device by which the smearing of ink on a printed web is avoided by increasing the viscosity of the ink printed onto the web. The increase in viscosity takes place following a first operation for cooling the web. The cooling device that is used may include rollers which are arranged within a rotary printing machine and are cooled by a coolant. On the other hand, the cooling may be effected by air cooling a closed section of the rotary printing machine or by feeding a cooling gas onto the surface of the printed material web.

U.S. Pat. No. 5,799,616 discloses a folder former nose which may be fastened on the folder former of a rotary printing machine. The folder former nose includes a base plate wherein a triangular plate is positioned. A cover plate is displaceably disposed on the triangular plate. Provided in the cover plate are openings which are formed by cutouts in the border region of the cover plate. A fluid flow, which prevents the web material running off on the folder former nose from coming into contact with the surface of the folder former nose, to pass out through the openings, in the border region of the folder former nose. By actuating motors connected to the displaceable cover plate, or of pneumatically actuating devices, it is possible to adjust the size of the opening of the cutouts on the folder former nose, as a result of which the outgoing fluid volume flow can be adapted to the rate of travel of the web-like materials conveyed over the former nose.

U.S. Pat. No. 5,947,411 and the published European Patent Document EP 0 945 385 A2 disclose a first longitudinal folding device for use in a web-fed rotary printing machine, wherein it is possible to regulate the fluid volume flow acting upon the surfaces of the folder former plate. For this purpose, the folder former plate is configured with two bases. Fluid volume flow outlets which are located above one another, and are distributed over the length of the folder former plate, are arranged in the base plate located beneath the folder former plate, whereon the web-like material runs off. Wedge-shaped adjusting elements are accommodated in the cavity between the folder former plate and the plate wherein the air-outlet openings are formed, the adjusting elements either increasing or reducing the size of the outlet openings for the fluid volume flow onto the upper side of the folder former plate. It is thus possible to adjust, on the upper side of the folder former plate, the volume flow passing through the correspondingly adjusted opening cross sections. The openings, which are bounded via the wedge-shaped displaceable adjusting elements, are formed, in the transition region of the folder former plates, in circular former bars, over the circumferential surface of which there exits the fluid volume flow passing out of the openings, contact of the web-like material both with the folder former bars and with the folder former plate thus being avoided. The regulation of the emerging or outgoing fluid volume flow which can be achieved by this construction involves an extremely high level of outlay, and requires a longitudinal folding configuration formed with two bases. Furthermore, the positioning accuracy of the wedge-shaped elements, which release or bound the outlet openings for the emerging volume flow, requires a high level of accuracy, which results in the associated actuating drives being correspondingly more costly.

The published Japanese Patent Document JP-H-7-47415 discloses a triangular folder former plate on a folder of a rotary printing machine. The surface of the folder former is provided with a multiplicity of openings. Positioned in these openings are spherical elements which are enclosed by corresponding holders or sockets. The spherical elements of the folder former plate are subjected to the action of individual spring elements positioned in the holders. A volume flow of a fluid is introduced into each of the holders, because each of the holders is provided with a compressed-air connection. Depending upon the movement of the spherical element accommodated in the respective holder, a volume flow onto the surface of the folder former plate is released or blocked.

SUMMARY OF THE INVENTION

Starting from the state of the art exemplified hereinbefore, wherein sometimes very complex proposals have been made for regulating the emerging or outgoing fluid volume flow for guiding, as contact-free as possible, a material web running off over a folder former plate, it is an object of the invention to provide a device for contact-free guidance of web-like material over a surface whereby contact-free run-off of the web-like material having different widths is regulated, with compressed-air losses which are as low as possible and with relatively simple equipment being employed in a first longitudinal folding arrangement.

With the foregoing and other objects in view, there is provided, in accordance with a first aspect of the invention, a device for contact-free guidance of a web material over a surface element whereon a first longitudinal fold is formed in the web material, comprising respective crossmembers disposed at the top and at the bottom of the surface elements, the surface element decreasing in width continuously from the top crossmember to the bottom crossmember, and being defined by boundary elements, the surface element and the boundary elements having a gaseous medium provided therein, an adjustable closure element for varying, in accordance with a respective format of the web material guided over the surface, a flow of a volume of the gaseous medium from an air cushion formed beneath the web material.

In accordance with another feature of the invention, the surface member has a surface disposed in a travel direction of the web material, the surface being formed with a plurality of openings disposed behind one another in the travel direction of the web material.

In accordance with a further feature of the invention, the openings, respectively, have a longitudinal extent exceeding, by a multiple, a transverse extent thereof in the surface.

In accordance with an added feature of the invention, at a rear side of the surface, the closure element faces towards at least one of the openings formed in the surface, the closure element being engageable with and being disengageable from the rear side of the surface.

In accordance with an additional feature of the invention, the closure element has a width exceeding the width of the openings formed in the surface.

In accordance with yet another feature of the invention, the closure element is mounted at a top end thereof so as to be pivotable about a pin.

In accordance with yet a further feature of the invention, the closure element extends, in the travel direction of the web material, between the top and the bottom crossmembers of a longitudinal folding device.

In accordance with yet an added feature of the invention, the closure element is manually adjustable from a position wherein it has been engaged with the surface, into a position wherein it is disengaged from the surface, and the reverse.

In accordance with yet an additional feature of the invention, the closure element is adjustable via an actuating drive acting upon spindle elements, from a position wherein it has been engaged with the surface, into a position wherein it is disengaged from the surface, and the reverse.

In accordance with still another feature of the invention, a threaded section formed on one of the spindle elements extends through an actuating lever for a cam, and has stops thereon for limiting vertical movement of the actuating lever.

In accordance with still a further feature of the invention, the closure element is pivotably mounted on the top crossmember.

In accordance with still an added feature of the invention, the surface element is a former plate, and the closure element is engageable more firmly with the first opening in the surface, as viewed in the web-travel direction, than with the adjacent openings in the former plate, as viewed in the web travel direction.

In accordance with still another feature of the invention, the closure element is pivotably mounted on the top crossmember and, on the bottom crossmember, is mounted on an adjustable pivoting cam supported by a carrier.

In accordance with another feature of the invention, the actuating lever for the cam serves for executing a vertical movement, as viewed in the web travel direction, for causing the cam, which is pivotable about an actuating pin, to execute a retraction and an extension movement, respectively.

In accordance with a second aspect of the invention, there is provided a device for forming a first longitudinal fold on one of a material web and material-web lengths, respectively, printed on at least one side thereof, which are guided in a contact-free manner over a surface element continuously decreasing in width from a top crossmember to a bottom crossmember, and being defined by boundary elements, the surface element and the boundary elements being formed with openings for a gaseous medium, comprising an adjustable closure element for varying, in accordance with a respective format of the web material guided over the surface, a flow of a volume of gaseous medium from an air cushion formed beneath the web material.

In accordance with a third aspect of the invention, there is provided an angle-bar superstructure having a device for forming a first longitudinal fold on one of a material web and material-web lengths, respectively, printed on at least one side thereof, which are guided in a contact-free manner over a surface element continuously decreasing in width from a top crossmember to a bottom crossmember, and being defined by boundary elements, the surface element and the boundary elements having openings for gaseous medium provided therein, comprising an adjustable closure element for varying, in accordance with a respective format of the web material guided over the surface, a flow of a volume of the gaseous medium from an air cushion formed beneath the web material.

In accordance with a fourth aspect of the invention, there is provided a web-processing rotary printing machine having a device for forming a first longitudinal fold on one of a material web and material-web lengths, respectively, printed on at least one side thereof, which are guided in a contact-free manner over a surface element continuously decreasing in width from a top crossmember to a bottom crossmember, and being defined by boundary elements, the surface element and the boundary elements having openings for gaseous medium provided therein, comprising an adjustable closure element for varying, in accordance with a respective format of the web material guided over the surface, a flow of a volume of the gaseous medium from an air cushion formed beneath the web material.

The advantages of the proposed device according to the invention are, in particular, that the air cushion produced, via the air outlet, from the air volume emerging from the surface-bounding elements can be varied on the outflow side simply via a very slight adjusting movement of a sheet-like element. This makes it possible for the air cushion emerging beneath the material web, which is to be guided, to be easily influenced without having any effect upon the compressed-air source. Depending upon the extent to which the closure element located on the rear side of the surface or surface element, for example, of a first longitudinal folding device has been adjusted, an air cushion which covers the width of the guide surface, i.e., of the former plate, is formed in the case of a maximum web width, the air cushion being fed by the air volume flows emerging from the former bars. Beneath the openings which are formed in the former plate and located behind one another, as viewed in the web travel or web-running direction, the closure element, which may be pivotable about a pin, acts as a throttling or restrictor element which throttles or restricts the flows of volumes of air flowing out of the air cushion, depending upon the extent to which it has been engaged with the rear side of the guide surface.

In a further advantageous configuration of the device proposed in accordance with the invention, a number of openings located behind one another, as viewed seen in the travel direction of the web-like material, are formed in the surface, for example, the top side of a former plate. The longitudinal extent of these openings exceeds by a multiple the transverse extent thereof in the surface above which the air cushion is formed beneath the web material. This configuration ensures that, by a just slightly adjustable closure element extending in the web travel direction, it is possible for the air cushion beneath the material web which is to be conveyed to be influenced in the longitudinal extent of the material web so that both materials of large width extents, i.e. large formats, and materials of small formats can be processed, and it is possible, in particular, for the formation of the air cushion beneath the material web, above the former plate, to be adapted to the width of the printing material, respectively, which is to be processed. By the term web material mentioned in this context, there is meant, in the graphics industry, material webs which are to be printed on one or more sides. These material webs, whether printed on one side or on both sides, may also include individual lengths of material web which are initially cut longitudinally, and then brought together again, in the angle-bar superstructure of a web-processing rotary printing machine.

In a further refinement of the concept upon which the invention is based, on that side of the former plate which is directed away from the web travel plane, the closure element, which is directed towards at least one of the slot-like openings, can be engaged with the former-plate side and withdrawn or disengaged therefrom. In an advantageous configuration, the closure element exceeds to a considerable extent the width of the former-plate openings assigned thereto. The configuration of the extent of overlap between the closure element and the material of the former plate extending alongside the slot-like opening makes it possible to increase further the restricting or throttling action which can be achieved as the closure element is engaged with the rear side of the former plate. Depending upon the extent by which the closure element is engaged with the rear side of the former plate, the gaseous-medium volume flowing out of the air cushion can be regulated extremely accurately.

With respect to the longitudinal extent of the closure element, at the top end thereof in the web travel direction, it is advantageously disposed so that it can be pivoted about a pin on the rear side of a first longitudinal folding device. In order to influence the air cushion, the closure element may advantageously extend over the entire length thereof, as viewed in the web travel direction, between the top crossmember of a first longitudinal folding device and a bottom crossmember. Assurance is thereby provided that influencing of the air cushion, i.e., the fluid-volume flows emerging from the air cushion, is provided by advancing or withdrawing the closure element, which extends in a web travel direction, it being possible for these movements to be performed by motor or manually. Depending upon the type of configuration and customer requirements, it is possible for the closure element, that can be actuated via spindle drives, for example, to be adjusted to the web-material width, respectively, which is to be processed, either via a handwheel or via an electric or pneumatic high-speed drive or the like, for example, even in the context of pre-setting when a new print job is being newly set up.

In another embodiment of the actuating device of the closure element, the latter may be actuated via spindle elements which can be moved at right angles to one another, it being possible for one of the spindle elements to be provided with a threaded section extending through an actuating lever whereon a cam is disposed for producing the advancement or withdrawal, i.e., the engagement and disengagement movement of the closure element. Depending upon the vertical displacement path covered by the actuating lever on the threaded section, it is possible to achieve a more-or-less pronounced extension movement of the cam, i.e. advancement of the closure element onto the rear side of the surface of the former plate. Depending upon the advancement, accordingly, the restricting cross sections formed between the rear side of the former-plate material and the front side of the closure element are of larger or smaller dimensions.

Due to the advantageous mounting of the closure element extending in the web travel direction, on the top crossmember of a first longitudinal folding device, it is possible, when the closure element is actuated, i.e. engaged with or advanced onto the rear side of the former-plate material, to achieve more pronounced engagement or advancement of the closure element, by way of the top region thereof, onto the first slot-like opening of the former plate, i.e., to achieve a greater restricting action in the wider region of the former plate. This may advantageously be achieved in that, when actuated, the closure element describes a rotary movement with respect to the pivot pin thereof.

It is advantageously possible for a vertical movement of the actuating lever, whereon the cam is accommodated, the vertical movement being achieved via a spindle of the spindle drive elements, to be converted into a movement wherein the cam is retracted or extended from the retracted position into an advanced position, respectively.

The device proposed in accordance with the invention for the contact-free guidance of web-like material over a surface may advantageously be used in web-processing rotary printing machines in the graphics industry. It is unimportant here whether the angle-bar superstructures of such web-processing rotary printing machines, whether for jobbing or for newspapers, process material webs which are printed on both sides or on one side or whether, in the angle-bar superstructures of such rotary printing machines, individual material webs are divided up into lengths of web which, after turning or rotation, are brought together again and then run into a folding module.

Other features which are considered as characteristic for the invention are set forth in the appended claims.

Although the invention is illustrated and described herein as embodied in a device for contact-free guidance of a web material over a surface, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
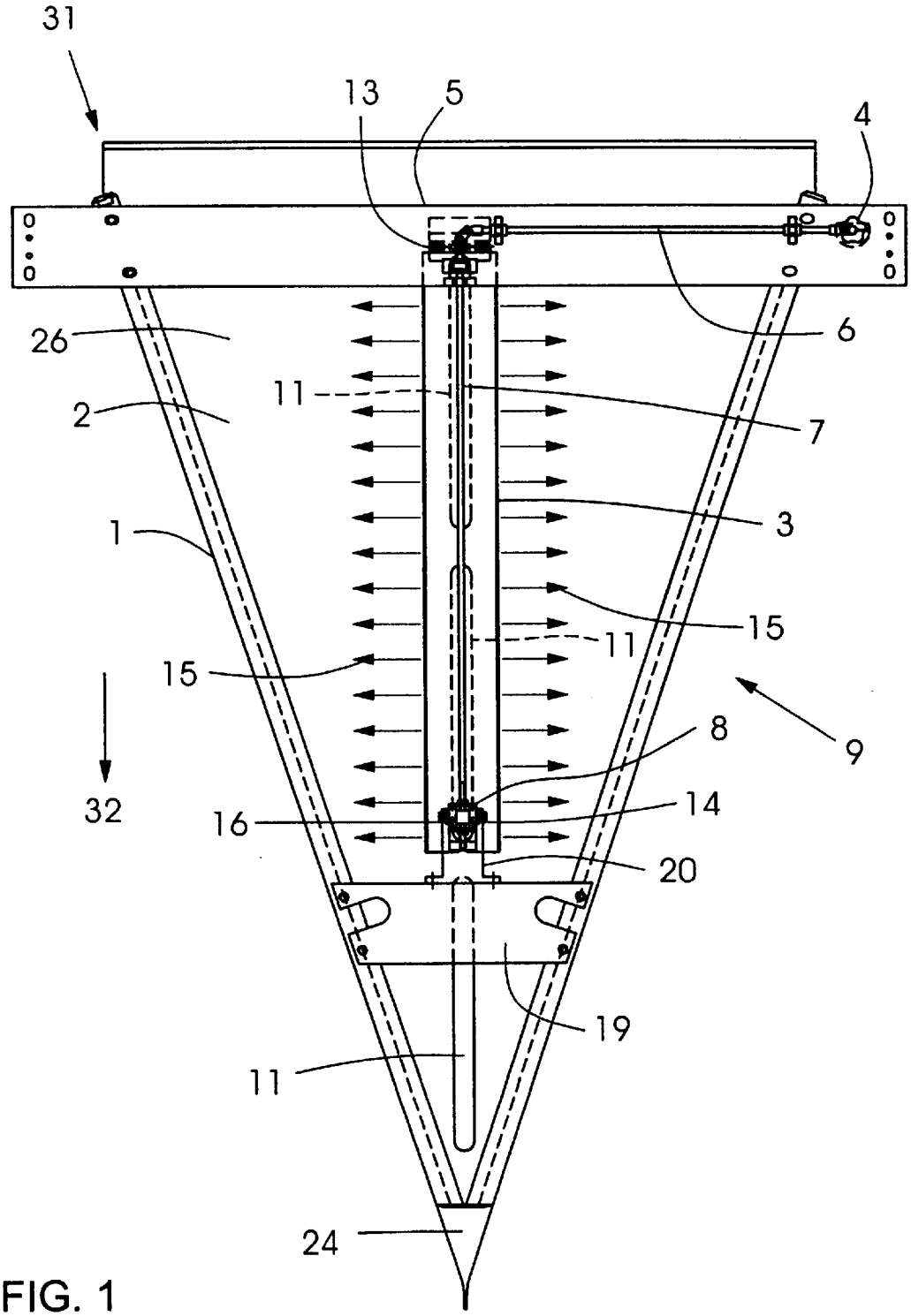
FIG. 1 is a rear elevational view of a first longitudinal folding device for a rotary printing machine, the folding device having a closure element that is adjustable via spindle-like elements.

Referring now to the drawings and, first, particularly to FIG. 1 thereof, there is shown therein, in a rear elevational view, a first longitudinal folding device 31, which may be provided, for example, on a web-processing rotary printing machine 9.

A folder former plate 2, which tapers continuously in width from a top crossmember 5 to a bottom crossmember 19, is bounded by two former bars 1 which are subjected to the action of a gaseous medium, for example compressed air. As viewed in the web-running or travel direction represented by the arrow 32, the former plate 2 of the first longitudinal folding device 31 is formed with slot-like openings 11, of which in this case, for example, three are located behind one another, passing through the center of the longitudinal folding device 31. In the configuration according to FIG. 1, the openings 11 are formed as narrow slots, of which the longitudinal extent exceeds by a multiple the extent of the width thereof. A closure element 3 is assigned to the two top slot-like openings 11. The closure element 3 overlaps the two openings 11 formed in the former plate 2, the openings 11 being disposed above one another, as viewed in the web travel direction 32, and is mounted so as to be rotatable about a pivot pin 13. An actuating lever 16 is accommodated at the bottom end of a vertically extending spindle section 7. The actuating lever 16 (note FIGS. 2 and 4) is accommodated on a carrier 20 which, for its part, is supported on the bottom crossmember 19 of the first longitudinal folding device 31. The two former bars 1, which bound the former plate 2, and effect the formation of an air cushion beneath the web supply 33 (note FIG. 3), run together into a former nose 24, a first longitudinal fold being formed in a material web passing the first longitudinal folding device 31, after the web has passed the former nose 24.

Due to the closure element 3, which is accommodated on the rear side 26 of the former plate 2 so as to be engageable therewith and disengageable therefrom, the outlet volume 15, which is indicated by the arrows on the closure element 3 which extend transversely to the web travel direction 32 on both sides, is adjusted and matched to the corresponding width, respectively, of the web material 33 which is to be processed.

Also illustrated in FIG. 1 is a handwheel 4 or similar manually actuatable device by which a spindle drive element 6 is rotatable. The spindle drive element 6 cooperates with a spindle drive element 7 which extends vertically in the web travel direction 32 and has, on the underside thereof, the actuating lever 16, which extends and retracts the cam 8, which is not clearly shown in FIG. 1. Instead of a manually actuatable handwheel 4, it is also possible to accommodate, on the top crossmember 5 of the first longitudinal folding device 31 according to FIG. 1, an actuating drive, for example, an electric motor, or some other drive, which allows the closure element 3 to be advanced into the engagement position thereof with the air-outlet openings 11 on the former plate 2, which are to be closed, so as to be pre-set in accordance with the width of the material web which is to be processed.

Figure 2:
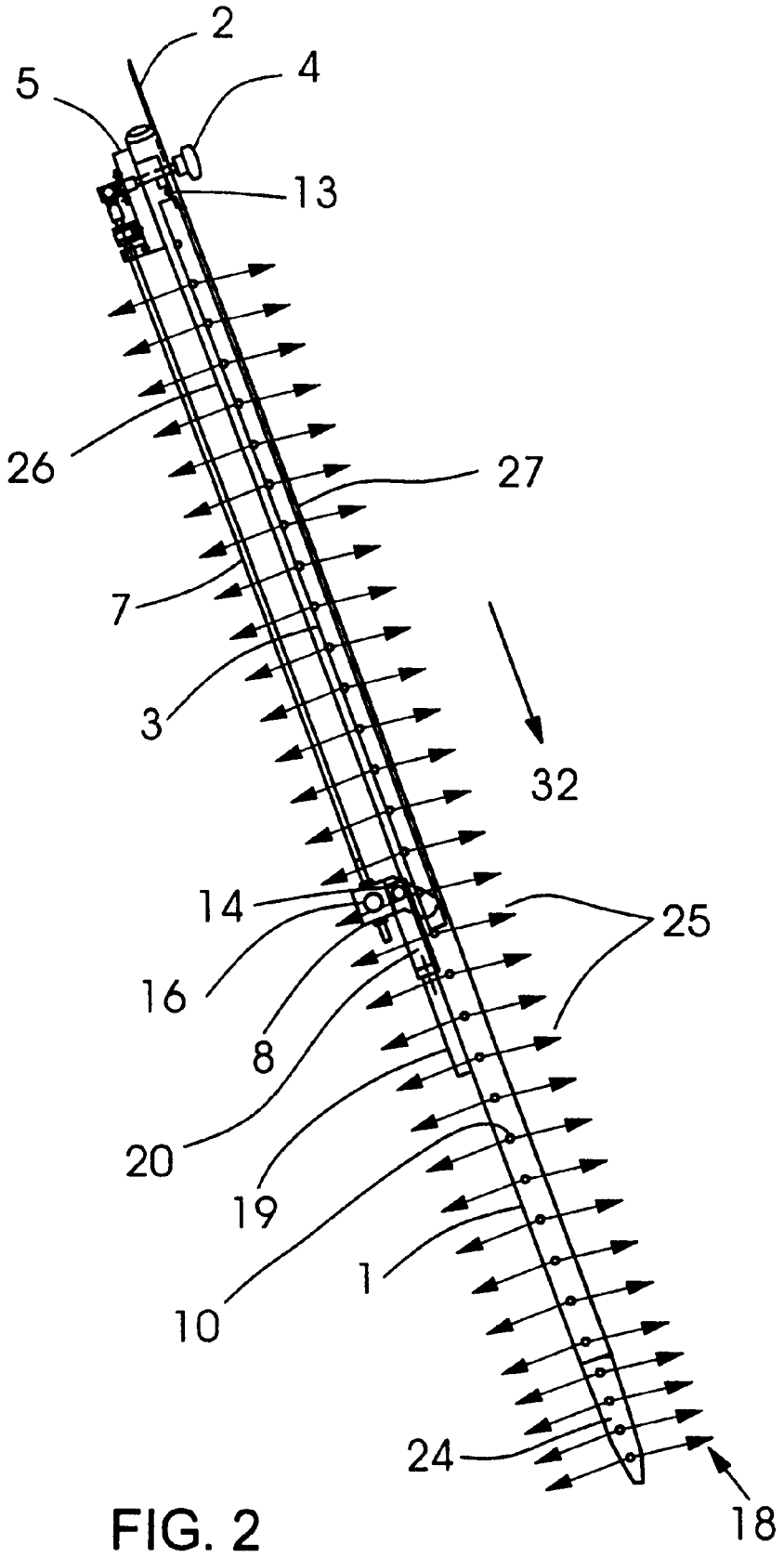
FIG. 2 is a side elevational view of FIG. 1, showing the first longitudinal folding device for a rotary printing machine, with the closure element in an engaged or advanced position thereof.

FIG. 2 is a side elevational view of the former plate 2, with a manually adjustable handwheel in the top region. The handwheel serves for rotating the aforementioned spindle 6, and acts upon a spindle drive element 7, which is positioned perpendicularly to the spindle 6 and moves an actuating lever 16 back and forth, respectively, in the vertical direction, i.e., parallel to the web travel direction 32. Accommodated on the vertically displaceable actuating lever 16 is an actuating cam 8 which is movable into a retracted position and an extended position, respectively, and by which the closure element 3 is engageable with the rear side 26 of the former plate 2. The slot-like air-outlet openings 11, which are not shown in FIG. 2, are located beneath the web travel plane, and disposed behind one another in the web travel direction 32. The closure element 3, which may be formed, for example, as a bent sheet-metal profile, is mounted so as to be rotatable about a pivot pin 13 extending perpendicularly to the plane of the drawing in FIG. 2. Extending parallel to the former plate 2 are the former bars 1, out of which a gaseous medium in the form of compressed air passes in the flow direction 25 on the upper side and underside, as viewed in FIG. 2, in order to build up an air cushion 17 beneath a material web which is to be conveyed over the former plate 2. Due to the air cushion 17, the underside of the material-web supply 33 which is to be conveyed is prevented from coming into contact both with the cylindrical lateral surfaces of the former bars 1 and with the planar surface 27 of the former plate 2.

It is thereby possible to prevent, in an effective manner, smearing of the just dried uppermost layer of ink on the underside of a freshly printed material web, which may also be formed from a plurality of lengths of web located above one another, which would otherwise adversely affect the quality of the printed product to be produced.

FIG. 2 shows a carrier 20 whereon a pivot pin 14 is accommodated. The spindle drive element 7, which extends in the vertical direction parallel to the former plate 2, is provided, in a bottom section thereof, with a threaded portion extending through the actuating lever 16, which is formed of bronze, for example. As the actuating lever 16 moves vertically in the direction of the arrows 21 and 22 (note FIG. 4), the actuating lever 16 rotates about the pivot pin 14, with the result that the cam 8, which is arranged on the actuating lever 16 beneath the bottom end of the closure element 3, is caused to execute a retraction and extension movement, respectively. A former nose 24 is formed at the bottom end of the former plate 2 and/or the former bars 1, with air jets likewise exiting from the former nose for the purpose of preventing contact between the material 33 running off in web form and the upper side of the former nose 24.

Figure 3:
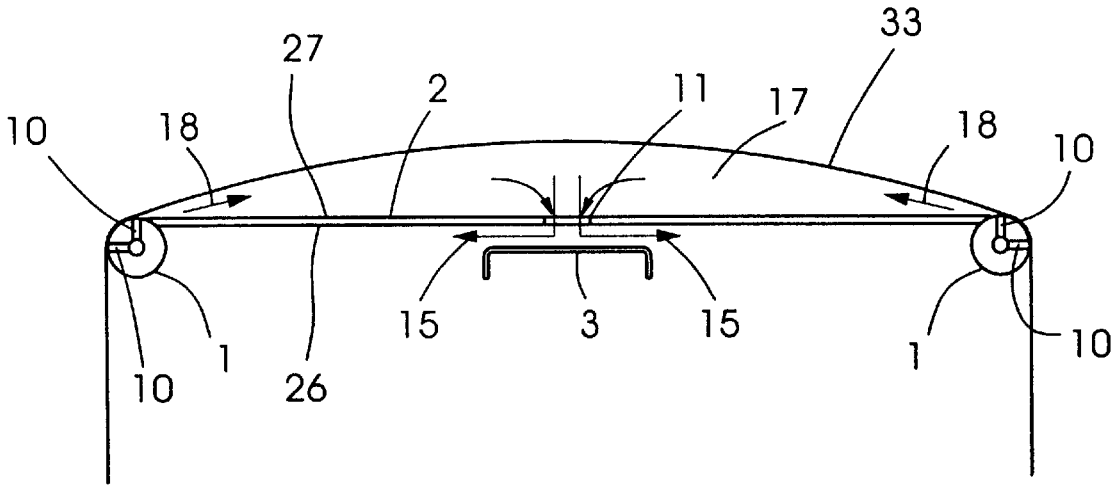
FIG. 3 is a diagrammatic view from above of an air cushion forming beneath the web material, and bounded on the underside thereof by the front side of a folder former plate, and also shown is the orientation of air-outlet openings in boundaries of the folder former plate.

FIG. 3 provides a diagrammatic view from above of the former plate 2.

The former plate 2 is of material thickness and has an underside 26 and an upper side 27. Illustrated in the central region between the former bars 1, which bound the former plate 2, is an opening 11 through which a volume of gaseous medium, which can be limited by the extent to which the former element 3 engages with the rear side 26 of the former plate 2, can exit from the air volume 17 closed off between the web material 33 and the former plate 2. The air volume 17 beneath the web-like material 33 is produced by subjecting the former bars 1, which extend parallel to the web travel direction 32, to the action of compressed air. The former bars 1 are provided, for example, with air-outlet openings 10 which, in the embodiment illustrated in FIG. 3, may be formed at an angle of 90° to one another on the circumference of the former bars 1. A gaseous medium in the form of compressed air exits from the air-outlet openings 10 of the former bars 1 and prevents the underside of the web-like material 33 from coming into contact with the lateral surfaces of the former bars 1 and the former plate 2. The air cushion 17 produced beneath the web-like material 33 is fed via the air jet 18 emerging from the former bars 1. The volume of air flowing out of the air cushion 17 is controlled by the engagement of the closure element 3 with the underside 26 of the former plate 2. A volume 15 of air flows out of the air cushion 17, the upper side of the closure element 3, constructed here, for example, as a sheet-metal profile, enclosing with the underside 26 of the former plate 2, gaps which function as throttling or restrictor elements.

Figure 4:
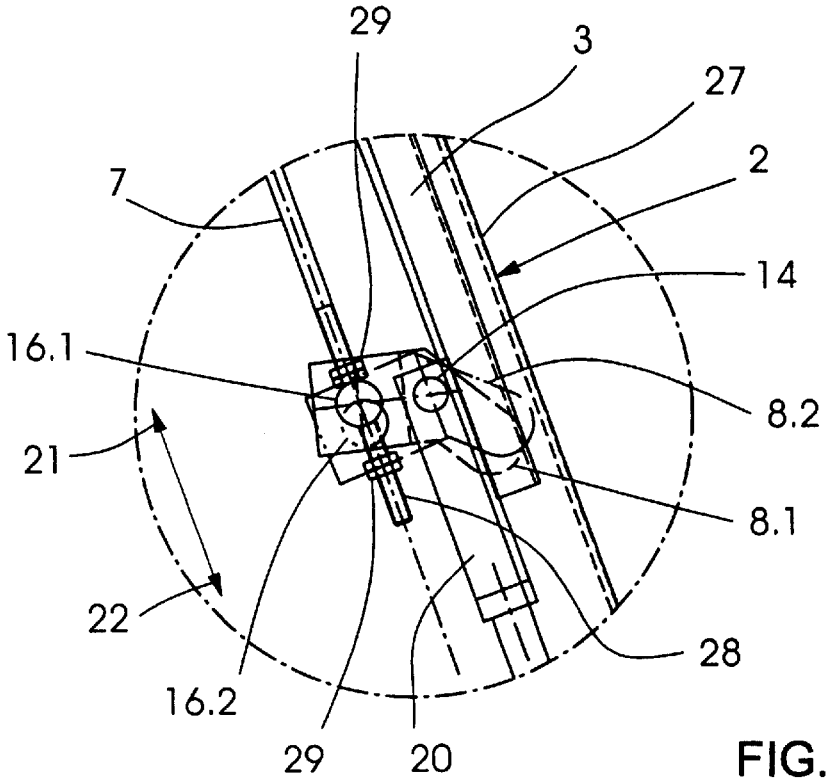
FIG. 4 is an enlarged fragmentary view of FIG. 2 showing an actuating device including a cam for actuating the closure element, the cam being illustrated in both an extended position and a retracted position thereof.

FIG. 4 is an enlarged fragmentary view of FIG. 2 showing the actuating lever 16 together with the cam accommodated therein, in the retracted and extended positions, respectively.

The spindle drive element 7 extends parallel to the web travel direction 32 and parallel to the former plate 2 and the former bars 1. In the bottom region of the spindle drive element 7, the latter is provided with a threaded section 28. The threaded section 28 is provided with two stops 29, which may be configured, for example, as a pair of nuts which are screwed onto the threaded section 28 opposite one another and a pair of lock nuts, respectively. Between the stops 29, the threaded section 28 of the spindle drive element 7 extends through a bushing on the actuating lever 16. When the threaded section 28 is rotated by rotating the spindle drive element 7, the actuating lever 16 executes a vertical upward and a vertical downward movement, respectively, depending upon the direction of rotation. Because the actuating lever 16 can be rotated about a pivot pin 14 of the carrier 20, a vertical upward movement or downward movement, respectively, of the actuating lever 16, by rotating the threaded section 28, causes the cam 8, which is connected to the actuating lever 16, to execute a retraction movement and an extension movement, respectively.

When the threaded section 28 is rotated in the direction of the arrow 21, i.e., in the closing direction, the actuating lever 16 moves into the position 16.1 thereof. As a result, the cam 8 is displaced into the retracted position 8.1 thereof. The closure element 3 is set back from the rear side 27 of the former plate 2. When the threaded section 28 of the spindle drive element 7 moves so that the actuating lever 16 is displaced in the direction of the double-headed arrow section 22, the actuating lever 16 moves in the direction towards the bottom stop 29 of the threaded section 28. In this case, the actuating lever 16 rotates into the position 16.2 thereof, with the result that the cam 8 pivots about the pivot pin 14 from the retracted position 8.1 thereof into the extended position 8.2 thereof. In the latter position, the closure element 3, rotatably mounted via the pivot pin 13 on the upper crossmember 5 of the longitudinal folding device 31, abuts with more pronounced effect the rear side 27 of the former plate 2. With respect to the slot-like openings 11 disposed behind one another in the former plate 2, a throttling action is produced thereby with respect to the air volume flowing out of the air cushion 17, so that, overall, a smaller air-outlet volume can flow out of the air cushion 17 via the air-outlet openings 11.

Figure 5:
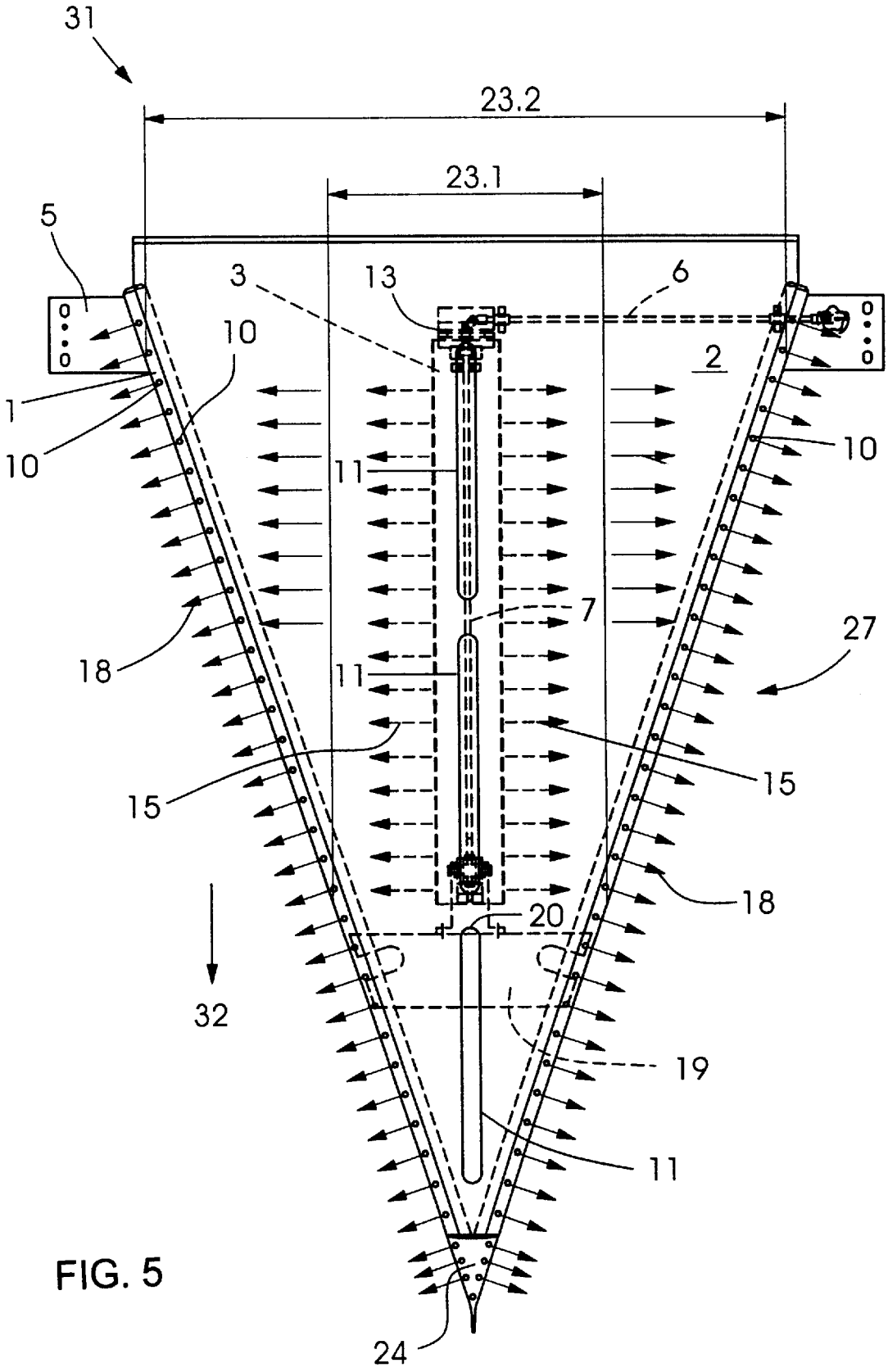
FIG. 5 is a front elevational view of FIG. 1 showing the first longitudinal folding device in a rotary printing machine, with outlines of maximum and minimum formats of the web-like material to be processed thereon.

Finally, FIG. 5 is a front elevational view of FIG. 1 showing the first longitudinal folding device 31 in greater detail. According to FIG. 5, the former plate 2 has a substantially triangular configuration and is closed off by the former bars 1, which form the lateral boundaries. The upper crossmember 5 and the bottom crossmember 19, the latter accommodating the carrier 20 for the actuating lever 16 together with the cam 8 accommodated thereon, extend transversely to the web travel direction 32.

The former bars 1, which form the boundary of the former plate 2, terminate in the former nose 24. Three openings 11 located behind one another, as viewed in the web travel direction 32, are formed in the former plate 2, of which the two top openings 11, as viewed in the web travel direction 32, are closable and releasable, respectively, to a certain extent by the closure element, which is represented here in broken lines. By the actuating device including the actuating lever 16 and the cam 8, which has already been described in conjunction with FIG. 4, it is possible to regulate the pivoting movement of the longitudinally extending closure element 3 about the pivot pin 13 and, even within the context of pre-setting, to pre-set the pivoting movement automatically in accordance with the material-web width 23.1 and 23.2, respectively, which is to be processed.

In the case of material webs having the width 23.2, which may cover the entire former plate 2, in order to avoid tearing the edges as a result of friction upon contact with the former plate 2 and the former bars 1, respectively, the closure element 3, during the processing of such webs, is adjusted about the pivot pin 13 thereof so that the closure element 3 closes to the greatest possible extent the first two slot-like openings 11, as viewed in the web travel direction, with the result that the air volume flowing out of the air cushion 17 is kept small. This ensures that the smallest possible air volume will leave the air cushion 17 via the openings 11, with the result that it is possible to produce and maintain a sufficiently dimensioned air cushion 17 beneath the material web 33. This prevents the edge regions of a material web 33 of the format 23.2 from coming into contact with the lateral surfaces of the former bars 1, and thus also prevents friction from causing the material web to tear and a consequent break in the web.

If, in contrast, material webs of the format 23.1 are processed, the closure element 3 extending in the web travel direction 32 is then moved away from the rear side 26 of the former plate 2, when the hand wheel 4 is actuated via the spindles 6 and 7, with the result that the air volume flowing out of the outlet openings 11 in the former plate 2 and leaving the air cushion 17 is at a maximum. Assurance is thereby provided that even a material web of a minimum web width 23.1 can be guided centrally in a contact-free manner over the first longitudinal folding device 31 without being damaged.

Air jets 18 which emerge from the circumferential surfaces of the former bars 1 taper triangularly in the direction towards the former nose 24, and serve for feeding the air cushion 17 beneath the web material 33. Outlet of the air jets 18 is also assured in the region of the former nose 24 of the first longitudinal folding device 31. In addition to providing that the air-outlet openings 10 in the former bars 1 be configured at an angle of 90° to one another, it is also possible to provide for the series of air-outlet openings 10 on the former bars 1 to be at other angles to one another. The angular position of the air-outlet openings 10, as well as the diameter of the air-outlet openings 10, respectively, are dimensioned so as to ensure the formation of an air cushion beneath the web material 33 to be conveyed, which avoids to a sufficient extent contact between the underside of the web material 33 and the stationary surfaces of the former bars 1 and the former plate 2, the size of the air cushion 17 being predeterminable manually or automatically by the gradually closable and releasable closure element 3 which serves as a throttle element.

We claim:

1. A device for contact-free guidance of a web material, comprising:

a surface element guiding the web material over said surface element and forming a first longitudinal fold in the web material on said surface element, said surface element having a top, a bottom and boundary elements, said surface element being formed with an opening through which air flows from an air cushion underneath the web material to a space underneath said surface element;

a top crossmember and a bottom crossmember disposed at said top and at said bottom of said surface element, respectively, said surface element decreasing in width continuously from said top crossmember to said bottom crossmember, and being defined by said boundary elements, said boundary elements having gaseous medium provided therein; and an adjustable closure element assigned to said opening of said surface element for varying, in accordance with a respective format of the web material guided over said surface element, a flow of gaseous-medium volume from the air cushion formed beneath the web material.

2. The device according to claim 1, wherein said surface element has a surface disposed in a travel direction of the web material, said surface being formed with a plurality of openings disposed behind one another in said travel direction of the web material.

3. The device according to claim 2, wherein said openings, respectively, have a longitudinal extent exceeding, by a multiple, a transverse extent thereof in said surface.

4. The device according to claim 2, wherein, at a rear side of said surface, said closure element faces towards at least one of said openings formed in said surface, said closure element being engageable with and being disengageable from said rear side of said surface.

5. The device according to claim 4, wherein said closure element is manually adjustable from a position wherein said closure element has been engaged with said surface, into a position wherein said closure element is disengaged from said surface, and the reverse.

6. The device according to claim 4, wherein said closure element is adjustable via an actuating drive acting upon spindle elements, from a position wherein said closure element has been engaged with said surface, into a position wherein said closure element is disengaged from said surface, and the reverse.

7. The device according to claim 6, wherein a threaded section formed on one of said spindle elements extends through an actuating lever for a cam, and has stops thereon for limiting vertical movement of said actuating lever.

8. The device according to claim 7, wherein said actuating lever for said cam serves for executing a vertical movement, as viewed in said web travel direction, for causing said cam, which is pivotable about an actuating pin, to execute a retraction and an extension movement, respectively.

9. The device according to claim 4, wherein said closure element is pivotably mounted on said top crossmember.

10. The device according to claim 4, wherein said surface element is a former plate, and said closure element is engageable more firmly with one of said plurality of openings in said surface, as viewed in said web-travel direction, than with the adjacent openings in said former plate, as viewed in said web-travel direction.

11. The device according to claim 4, wherein said closure element is pivotably mounted on said top crossmember and, on said bottom crossmember, is mounted on an adjustable pivoting cam supported by a carrier.

12. The device according to claim 2, wherein said closure element has a width exceeding the width of said openings formed in said surface.

13. The device according to claim 2, wherein said closure element extends, in said travel direction of the web material, between said top crossmember and said bottom crossmember.

14. The device according to claim 1, wherein said closure element is mounted at a top end thereof so as to be pivotable about a pin.

15. A device for forming a first longitudinal fold on one of a material web and material-web lengths, respectively, printed on at least one side thereof, and being guided in a contact-free manner, the device comprising:

a surface element guiding the web material over said surface element and forming a first longitudinal fold in the web material on said surface element, said surface element having a top, a bottom and boundary elements, said surface element being formed with an opening through which air flows from an air cushion underneath the web material to a space underneath said surface element;

a top crossmember and a bottom crossmember disposed at said top and at said bottom of said surface element, respectively, said surface element decreasing in width continuously from said top crossmember to said bottom crossmember, and being defined by said boundary elements, said boundary elements being formed with openings for a gaseous medium; and an adjustable closure element assigned to said opening of said surface element for varying, in accordance with a respective format of the web material guided over said surface element, a flow of a volume of the gaseous-medium from the air cushion formed beneath the web material.

16. A web-processing rotary printing machine, comprising:

a device for forming a first longitudinal fold on one of a material web and material-web lengths, respectively, printed on at least one side thereof, and being guided in a contact-free manner, the device including:

a surface element guiding the web material over said surface element and forming a first longitudinal fold in the web material on said surface element, said surface element having a top, a bottom and boundary elements, said surface element being formed with an opening through which air flows from an air cushion underneath the web material to a space underneath said surface element;

a top crossmember and a bottom crossmember disposed at said top and at said bottom of said surface element, respectively, said surface element decreasing in width continuously from said top crossmember to said bottom crossmember, and being defined by said boundary elements, said boundary elements having openings for gaseous medium provided therein; and an adjustable closure element assigned to said opening of said surface element for varying, in accordance with a respective format of the web material guided over said surface element, a flow of a volume of the gaseous-medium from the air cushion formed beneath the web material.

17. A device for longitudinally folding a web, comprising:

a folder former plate having at least one opening;

two former bars bounding said folder former plate and running together into a former nose, said two former bars being subjected to compressed air for forming an air cushion between the web and said folder former plate; and a closure element assigned to said at least one opening, said closure element adjusting an outlet volume of air flowing out of the air cushion through said at least one opening.

* * * * *